US006645164B2

(12) United States Patent
Manska

(10) Patent No.: US 6,645,164 B2
(45) Date of Patent: Nov. 11, 2003

(54) LINGUAL VIBRATION DEVICE

(76) Inventor: Wayne E. Manska, 1921 Kellogg Dr., Anaheim, CA (US) 92807

( * ) Notice: Subject to any disclaimer, the term of this patent is extended or adjusted under 35 U.S.C. 154(b) by 125 days.

(21) Appl. No.: 09/912,667

(22) Filed: Jul. 24, 2001

(65) Prior Publication Data

US 2002/0188235 A1 Dec. 12, 2002

(51) Int. Cl.[7] ..... A61H 1/00
(52) U.S. Cl. ..... 601/70; 601/46; 601/67
(58) Field of Search ..... 606/234, 235; 601/56–60, 67–73, 139, 143, 144, 147

(56) References Cited

U.S. PATENT DOCUMENTS

| | | | | | |
|---|---|---|---|---|---|
| 3,115,139 | A | * | 12/1963 | Schneider | 606/235 |
| 3,557,781 | A | * | 1/1971 | Kaye, Sr. | 601/71 |
| 4,123,844 | A | * | 11/1978 | Kurz | 433/5 |
| 4,348,178 | A | * | 9/1982 | Kurz | 433/6 |
| 4,765,037 | A | * | 8/1988 | Perry | 24/301 |
| 4,841,954 | A | * | 6/1989 | Kalsi | 601/71 |
| 4,969,894 | A | * | 11/1990 | Hempstead-Harris | 606/234 |
| 5,693,073 | A | * | 12/1997 | Glick et al. | 606/236 |
| 5,967,784 | A | * | 10/1999 | Powers | 433/229 |
| 6,068,649 | A | * | 5/2000 | Chamberlain | 606/234 |
| 6,193,742 | B1 | * | 2/2001 | Moriarty | 606/234 |
| 6,264,678 | B1 | * | 7/2001 | Landers | 606/236 |
| 6,382,815 | B1 | * | 5/2002 | Klearman et al. | 362/253 |

OTHER PUBLICATIONS

Tongue Joy™ Website Homepage (www.TongueJoy.com) (1 sheet).
TongueJoy™ Frequently Asked Questions (www.TongueJoy.com/Faq/Index) (2 sheets).
TongueJoy™ Instruction Sheet (Supplied With Product) From: JJK Industries, L.P. 6425 South IH 35 Suite 105, PMB 134 Austin, TX 78744 (2 sheets).
"Tongue Vibrator" Dialog From: www.HalfBakery.com/Idea/Tongue_20Vibrator (2 sheets).

* cited by examiner

*Primary Examiner*—Justine R. Yu

(57) ABSTRACT

A vibrating oral sex enhancement device comprising a mouthpiece and a controller. The mouthpiece retains a vibrator that is connected to the controller by electrical conductors, whereas the controller comprises a battery compartment, a battery and a switch and functions to power the vibrator. In use, a surface of the mouthpiece adjacent the vibrator contacts and imparts vibrations to the user's tongue, which results in increased sexual pleasure to the user's partner during oral sex. The device is comfortably stabilized in the user's mouth such that vibrations are optimally imparted to the tongue while leaving the tongue free to move with respect to the mouthpiece. In certain embodiments the mouthpiece is stabilized by integral features of the mouthpiece itself. In other embodiments, the mouthpiece is stabilized by external structures such as elastic straps that are adapted to engage a posterior surface of the user's head, neck or ears in such manner that a rearward, stabilizing force is imparted to the mouthpiece.

6 Claims, 11 Drawing Sheets

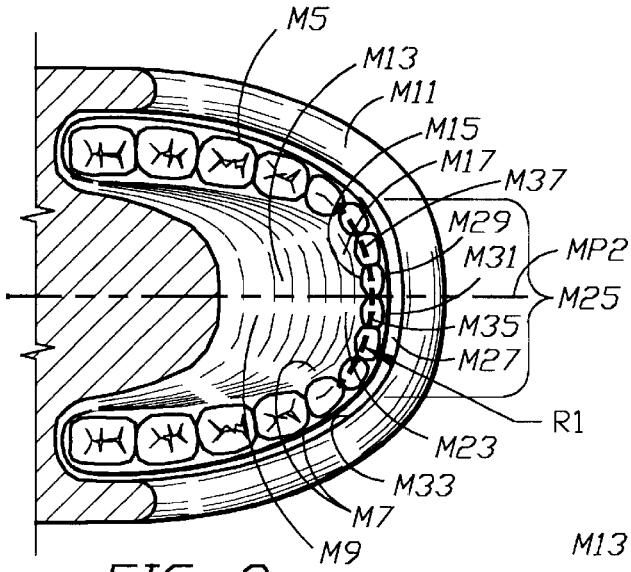
FIG. 2
FIG. 3
ROTATED 45° CW
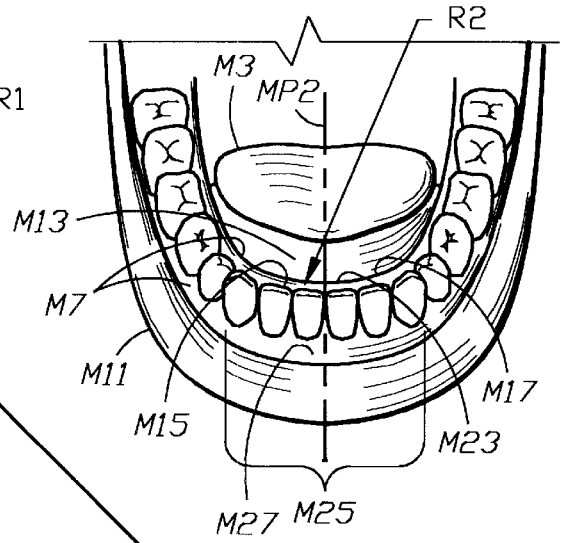
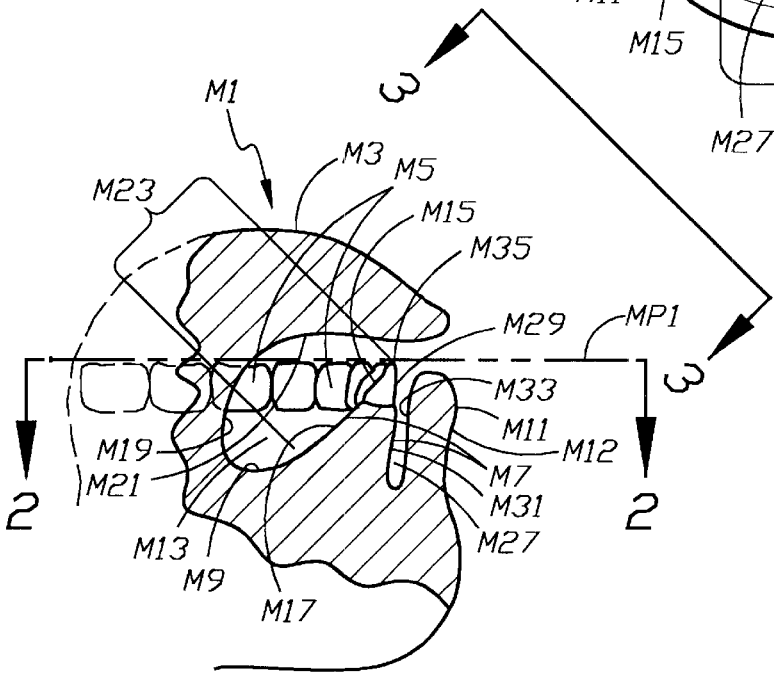
FIG. 1

ROTATED 45° CW

LINGUAL VIBRATION DEVICE

FIELD OF THE INVENTION

This invention relates to vibrating sexual enhancement devices designed to increase sexual stimulation and more particularly to devices that improve gratification during oral-genital sex acts.

BACKGROUND OF THE INVENTION

It is well known by those knowledgeable in the art that vibrating devices can greatly enhance sexual stimulation. In use, these devices typically directly contact the area to be stimulated. Such devices work well when used for self-masturbation whereby the user and the recipient are the same person. This is because the user feels the resulting sensations and he/she is therefore able to optimally manipulate the device. However, when one person uses such devices to stimulate another there is no auto-tactile feedback to the user making it difficult to apply the precise amount of force to precisely the right area. Often too much or too little force is applied, and often to the wrong areas. This can become especially problematic in the case where the device is used for clitoral stimulation. This is because a woman's clitoris can be extremely sensitive, and harsh or direct stimulation can actually be irritating or even painful. Although clitoral stimulation is the only way some women can achieve orgasm, overly aggressive or improper stimulation can accordingly be adversely effective.

An intimate and sensual means of accomplishing clitoral stimulation between sex partners is oral sex, which can be used as a means of foreplay to increase a woman's arousal before intercourse, or as a complete sex act to bring the woman to orgasm. During this act the woman's partner experiences lingual tactile feedback and is therefore more able to effectively control both the force and location of the stimulation given in order to achieve the desired sensations. In an attempt to optimize these sensations the woman's partner often tries to rapidly flick or "vibrate" his/her tongue on and around the woman's clitoris. But due to biomechanical limitations it is difficult, if not impossible, to achieve the sensual cyclic rapidity of an electro-mechanical vibration device.

One form of a certain prior-art device comprises a vibrator that is attached to an elastic ring that encircles the user's tongue. A problem with this device is that it has exposed metal surfaces that can irritatingly contact and, by admission, even damage the user's teeth. In an attempt to address this problem, the device is provided with elastomeric sleeves, however the sleeves only shroud a portion of the metal surfaces leaving major portions uncovered. Also the sleeves are thin-walled and are therefore inadequately effective. Another problem with the device is that since the tongue is compliant and tapers toward its tip, the elastic ring easily slips inappropriately forward to the extent that the vibrator rattles against the user's anterior teeth or even falls out of the user's mouth. Also, the constrictive elastic ring can be quite uncomfortable. In another form of the device, the vibrator is attached to the user's tongue by means of a shaft, which passes through a hole pierced in the tongue and is then screwed into an opposing barbell. A problem with this device is that its use is limited to those individuals having pierced tongues.

Accordingly, there is a need in the art for a comfortable, reliably stabilized device that enables lingual tactile feedback while causing a user's tongue to rapidly, yet gently, vibrate during various oral sex acts such as cunnilingus. And also a device that is useable by anyone.

SUMMARY OF THE INVENTION

The present invention is a device for use during oral sex that causes a user's tongue to vibrate. The device comprises a mouthpiece containing an electrically powered vibrator, and a controller. In the preferred embodiment, the mouthpiece is bilaterally symmetrical to a vertical plane that is coincident with the sagittal plane of symmetry of the user. The mouthpiece includes a constrained portion adapted to fit in the user's mouth below the tongue in a sub-lingual basin that is defined by the lingual surfaces of the mandibular teeth and gums, the floor of the mouth, and a basal portion of the inferior surface of the tongue. The sub-lingual basin has an anterior portion essentially comprising the lingual surfaces of the anterior mandibular teeth and gums. The anterior portion has a substantially cylindrically curved surface having a radius that varies somewhat between different individuals within a range of about 0.75 inch to about 1.0 inch. The constrained portion of the mouthpiece has a length between an anterior end and a posterior end, and a thickness between an upper surface and a lower surface. During use, the upper surface contacts the inferior surface of the users' tongue, the lower surface contacts the anterior portion of the sublingual basin, and the anterior end is situated adjacent the upper edges of the anterior mandibular teeth. The constrained portion is constrained in the sub-lingual basin as it is held against the anterior portion by the inferior surface of the tongue. As used herein, terms such as "anterior", "posterior", "upper" and "lower" and other terms describing orientation of features of the mouthpiece relate to the mouthpiece when it is appropriately positioned in the user's mouth as the user's head is upright.

The mouthpiece includes a retaining means for retaining the vibrator in an orientation perpendicular to the vertical plane of symmetry of the mouthpiece. A portion of the upper surface of the mouthpiece adjacent the user's anterior mandibular teeth is preferably situated above an occlusal plane that is coincident with the tops of the mandibular teeth. This assures that vibrations are optimally imparted to the tongue, and also helps prevent the tongue from contacting the tops of the anterior mandibular teeth, which could act to dampen the tongue's vibrations. The vibrator is connected via electrical conductors such as wires to the controller whereby the controller comprises a battery compartment, a battery, and an electrical switch that serves to turn the vibrator on and off. The battery compartment includes a cover that is at least partially removable for the purpose of providing access thereto. The vibrator comprises a capsule made of a rigid material that encapsulates an electric motor having a shaft that has an eccentric weight attached thereto which causes the vibrator to vibrate when the shaft rapidly rotates. The vibrator is preferably approximately 1.0 inch long and about 0.4 inch in diameter. This size satisfies spatial constraints inherent with the location and function of the mouthpiece while allowing for a vibrator having sufficient energy to impart adequate vibrations to the tongue. The vibrator may be permanently encased within the mouthpiece or it may be removable/replaceable. If permanently encased it is hermetically sealed therein to prevent moisture such as saliva from entering the cavity during use or other liquids during cleaning. This protects the vibrator's electronics from possibly shorting and also seals habitats that could harbor and support the growth of deleterious microorganisms. If removable/replaceable, the vibrator itself is hermetically sealed for the same reasons.

The mouthpiece is made substantially of a compliant, resilient material such as silicone, vinyl, or latex or a non-reticulated foamed plastic material. Such materials act to dampen the harsh vibrations of the rigid vibrator against the user's sensitive, unyielding teeth and gums while facilitating the transmission of vibrations to the supple tongue. Also, such compliant materials enable the mouthpiece to yieldingly adapt to fit variations in the anatomical contours of individual user's mouths. Additionally, when the constrained portion is held against the anterior portion of the basin by the tongue, the compliant material embeds into and conforms to irregularities and crevices in the user's teeth and gums, which helps to stabilize the device.

In the preferred embodiment, the mouthpiece includes additional stabilizing means comprising at least one surface or feature that cooperates with the mouth's anatomy to keep the vibrator properly positioned beneath the tongue for optimal performance. A mouthpiece not having such a feature can become unstable during use whereby it may twist, roll or shift out of position to the extent that it becomes ineffective, or even worse, may be accidentally ejected from the mouth. For example, if the entire mouthpiece were simply cylindrical, it may twist such that it only contacts a small area on the side of the lower surface of the tongue. Or, it may move extremely downward and rearward in the sub-lingual basin whereby the vibrations are inefficiently absorbed by the overwhelming mass of the surrounding soft tissue at a location too far from the tip of the tongue to be satisfactorily effective. In either situation the vibrations are not optimally imparted to the tip of the tongue where they are desired.

In a preferred embodiment, providing a constrained portion that is elongate when viewed from the side, whereby its length is greater than its thickness, enhances stabilization. In this embodiment, the lower surface is configured to contact the anterior portion of the sub-lingual basin along a span in the direction of the length, which hinders the mouthpiece from rolling toward the basal portion of the inferior surface of the tongue, even in the absence of other stabilizing means. In this embodiment, stabilization is further enhanced by providing a lower surface configured to compliment the substantially cylindrical contour of the anterior portion of the sub-lingual basin, consequently hindering the mouthpiece from rotating about an axis perpendicular to the anterior portion. Solely, or in combination, these features enable the constrained portion to be trapped and substantially immobilized against the curved surface of the anterior portion by the inferior surface of the tongue.

In certain preferred embodiments, the mouthpiece includes a frontal portion that adjoins and protrudes from the anterior end of the constrained portion. The extent of horizontal protrusion of the frontal portion should be less than 1.0 inch so as not to interfere with the performance of the user's extended tongue. The frontal portion minimally comprises a tooth-rest having a bottom surface that forms an included angle less than 180° with the lower surface of the constrained portion. The tooth-rest is adapted to rest on the upper edges of the user's lower incisors thereby providing additional stabilizing means as the inferior surface of the tongue presses the tooth-rest into these teeth. In other preferred embodiments, the frontal portion additionally includes a protuberance that projects downward from the tooth-rest, and is adapted to grip the user's anterior mandibular teeth in cooperation with the lower surface of the constrained portion, thereby providing even another stabilizing means. Alternatively, the frontal portion may include a protuberance that projects downward from the tooth-rest that is adapted to grip the user's lower lip in cooperation with the lower surface of the constrained portion.

Various other embodiments of the device may be provided with respect to the location of the retaining means and the battery compartment and/or electrical switch of the controller without departing from the scope of the invention. For example, the retaining means may be situated in either the constrained portion or the frontal portion adjacent the anterior mandibular teeth. If the retaining means is in the constrained portion, the frontal portion may comprise either a tooth-gripping protuberance or a lip-gripping protuberance that includes the battery compartment and/or electric switch. Conversely, if the retaining means is in the frontal portion, the battery compartment and/or electric switch may be situated in the constrained portion. If the battery compartment and/or electric switch is situated in either the constrained portion or a tooth-gripping protuberance they/it are/is hermetically sealed to prevent propagation of microorganisms and electrical shorts. In any of these instances, the controller may alternatively be remote from the mouthpiece in which case it is connected thereto by the electrical conductors.

In even other embodiments additional stabilization is achieved by providing an external stabilizing means in the form of a strap that is attached to the mouthpiece and wraps around the user's head, neck or ears. The strap is preferably made, at least partially, of an elastic material and also preferably includes an adjustment means that functions to adjust its length.

Accordingly, it is an object of the present invention to provide an oral sexual enhancement device that causes a user's tongue to vibrate.

Another object of the invention is to provide a sexually stimulating device that facilitates lingual tactile feedback.

Yet another object of the invention is to provide a sexual enhancement device that can readily help a woman approach and achieve orgasm in an intimate manner with her sex partner.

Yet even another object of the invention is to provide an oral sexual enhancement device that is reliably stabilized during use and can be used by anyone.

DESCRIPTION OF THE DRAWINGS

These and other considerations and features of the present invention may be more fully understood through reference to the drawings in which:

FIG. 1 is a partially cross-sectioned side view of an individual's mouth showing a sub-lingual basin having an anterior portion, and other anatomical features relevant to the present invention;

FIG. 2 is a plan view of the individual's lower mouth taken along lines 2—2 of FIG. 1;

FIG. 3 is a downwardly biased front view of the lower mouth taken along lines 3—3 of FIG. 1 showing a cylindrically concave curvature of the lingual surface of the mandibular teeth and gums;

DESCRIPTION OF THE PREFERRED EMBODIMENTS

FIGS. 1–3 show anatomical features of an individual's mouth M1 relevant to the present invention including; the tongue M3, the mandibular teeth M5, the mandibular gums M7, the floor M9 of the mouth M1, and the lower lip M11 that has an outer surface M12. Also shown is a sub-lingual basin M13 defined by the lingual surfaces M15, M17 of the mandibular teeth M5 and gums M7, respectively, the floor M9 of the mouth M1 and a basal portion M19 of the inferior surface M21 of the tongue M3. The sub-lingual basin M13 has an anterior portion M23 that comprises the lingual surfaces M15, M17 in the area of the anterior mandibular teeth M25, which comprise incisors and canines. Also shown is the vestibule M27 between the labial surfaces M29, M31 of the anterior mandibular teeth M25 and gums M7, respectively, and the inner surface M33 of the lower lip M11. FIG. 1 shows an occlusal plane MP1 that is coincident with the tops of the mandibular teeth M5 including the upper edges M35 of the anterior mandibular teeth M25. As seen in FIG. 2, the mouth MI is bilaterally symmetrical to a sagittal plane MP2. It is also shown that the upper edges M35 of the lingual surfaces M15 of the anterior mandibular teeth M25 form an arch M37, shown as a dashed line, which has a radius R1 that is approximately 0.75 to 1.0 inch, depending on the individual. FIG. 3 shows the anterior portion M23 of the sub-lingual basin M13 has a concave, substantially cylindrical surface having a radius R2, which approximates radius R1.

Figure 4:
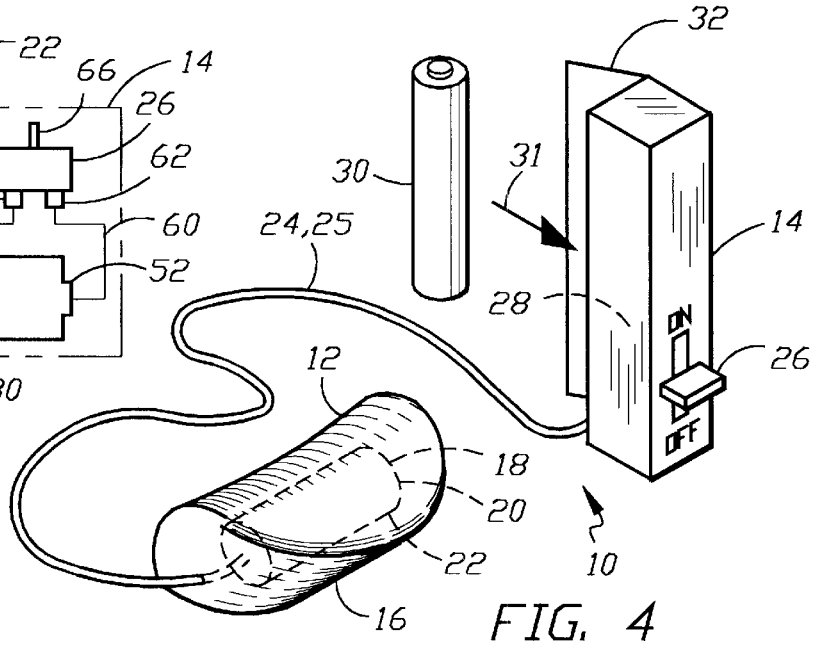
FIG. 4 is an isometric drawing of a preferred embodiment of the present invention, showing a device comprising a mouthpiece interconnected by electrical conductors to a remote controller.

A preferred embodiment of a device 10 of the present invention comprising a mouthpiece 12 and a controller 14 is shown in FIG. 4. The mouthpiece 12 is made of an elastomeric, resilient material such as silicone, vinyl, latex, or a non-reticulated foamed plastic. The mouthpiece 12 totally comprises a constrained portion 16 that is adapted to fit in the user's mouth M1 below the tongue M3 in the sub-lingual basin M13 shown in FIGS. 1–3. The constrained portion 16 includes a retaining means 18 in the form of a chamber 20 that functions to encapsulate and retain a vibrator 22 that is interconnected with the controller 14 by first and second electrical conductors 24, 25, respectively. The chamber 20 is hermetically sealed to prevent the introduction and propagation of deleterious microorganisms and also to prevent electrical shorts. The controller 14 includes an electric switch 26 that functions to turn the vibrator 22 on and off. The controller 14 also includes a battery compartment 28 that is used to store a battery 30 that serves to power the vibrator 22. The battery 30, shown removed, is installable into the battery compartment 28 as indicated by an arrow 31. A cover 32 that is either hinged or removable is provided for accessing the battery compartment 28.

Figure 5:
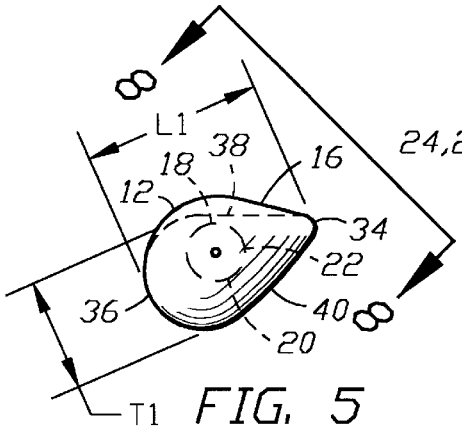
FIG. 5 is a side view of the mouthpiece of FIG. 4 showing a retaining means for retaining a vibrator, and a lower surface that acts as a stabilizing means.
Figure 6:
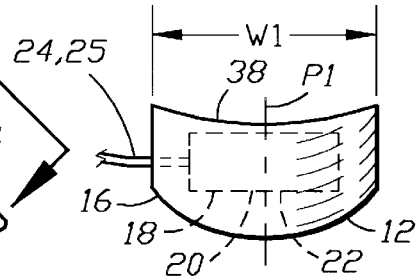
FIG. 6 is a front view of the mouthpiece of FIG. 4 orthographically projected from FIG. 5, showing an upper surface on which the user's tongue rests.
Figure 8:
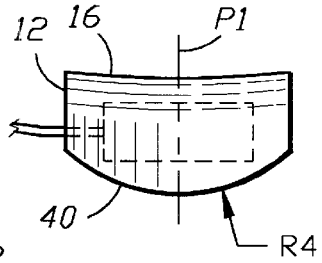
FIG. 8 is a downwardly biased front view of the mouthpiece of FIG. 4 taken along lines 8—8 of FIG. 5, showing a convex bottom contour that compliments the concave curvature shown in FIG. 3.
Figure 7:
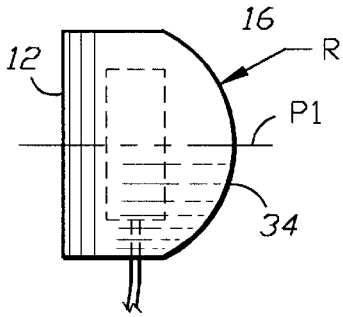
FIG. 7 is a bottom view of the mouthpiece of FIG. 4 orthographically projected from FIG. 5, showing a curved anterior edge.

Referring to FIG. 5, the constrained portion 16 has an anterior end 34 and a posterior end 36 having a length L1 therebetween. The constrained portion 16 also has an upper surface 38 and a lower surface 40 having a thickness T1 therebetween whereby the thickness T1 is preferably less than the length L1. To better suit the fit and function of the mouthpiece in the absence of additional stabilizing means, the anterior end 34 is preferably thinner than portions posterior thereto such that the constrained portion 16 appears substantially teardrop shaped in side view. As seen in FIG. 6, the mouthpiece 12 is bilaterally symmetrical to a vertical plane of symmetry P1 that, in use, is coincident with the sagittal plane MP2 of symmetry of the user's mouth M1 shown in FIGS. 2 & 3. It is also shown that the vibrator 22 is oriented perpendicular to the plane P1, which is favorable for two reasons. First, it best suits the geometry of preferred embodiments of the invention. Second, it situates the vibrator 22 in a transverse orientation with respect to a user's tongue thereby allowing the entire vibrator 22 to be nearer the tip of the tongue where the transmitted vibrations are desired. The upper surface 38 is concave, which provides a comfortable cradle for the user's tongue during use. The constrained portion 16 has a width W1 that is less than 1.50 inches, which permits the constrained portion 16 to fit in the sub-lingual basin M13 illustrated in FIGS. 1–3. As illustrated in FIG. 7, the anterior end 34 is curved having a radius R3 that substantially matches the radius R1 of curvature of the lingual surfaces M15 of the anterior mandibular teeth M25 (FIG. 1). As shown in FIG. 8, the lower surface 40 is cylindrically convex having a radius R4 that compliments the cylindrical radius R2 of the anterior portion M23 of the sub-lingual basin M13 (FIG. 3).

Figure 9:
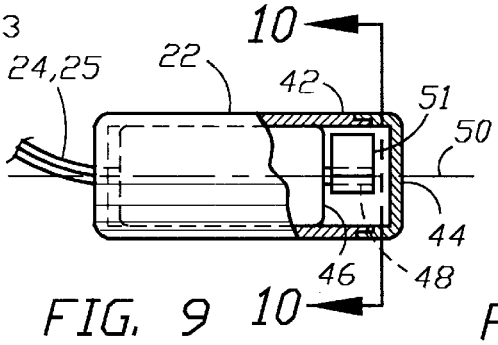
FIG. 9 is an enlarged partially sectioned side view of the vibrator of FIGS. 4–8, showing a container containing a motor having an eccentric weight attached to its shaft.
Figure 10:
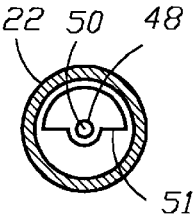
FIG. 10 is a cross-sectional view of the vibrator taken along lines 10—10 of FIG. 9 showing the eccentric weight that causes the vibrator to vibrate.

As shown in FIG. 9, the vibrator 22 comprises a container 42 and a container cover 44 that serve to encapsulate a low voltage electric motor 46 having a shaft 48 that rotates about an axis 50. The shaft 48 has an eccentric weight 51 attached that causes the vibrator 22 to vibrate when the motor 46 is activated. FIG. 10 shows the eccentric disposition of the weight 51 relative to the shaft 48.

Figure 11:
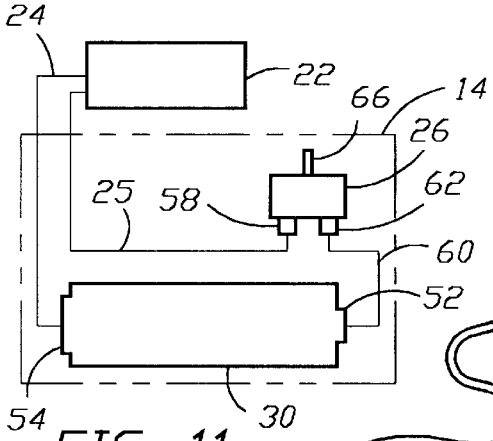
FIG. 11 is a wiring diagram showing electrical connections between components of the device illustrated in FIGS. 4–10.

FIG. 11 shows the electrical interconnections between the battery 30 and switch 26 of the controller 14, and the vibrator 22. The battery 30 is shown having a positive terminal 52 and a negative terminal 54. The first electrical conductor 24 interconnects the vibrator 22 with the negative terminal 54 on the battery 30, the second electrical conductor 25 interconnects the vibrator 22 with a first terminal 58 on the switch 26, and a third electrical conductor 60 interconnects a second terminal 62 on the switch 26 with the positive terminal 52 on the battery 30. The switch 26 includes an actuator 66 that functions to make or break the electrical connection between the battery 30 and the vibrator 22.

Figure 12:
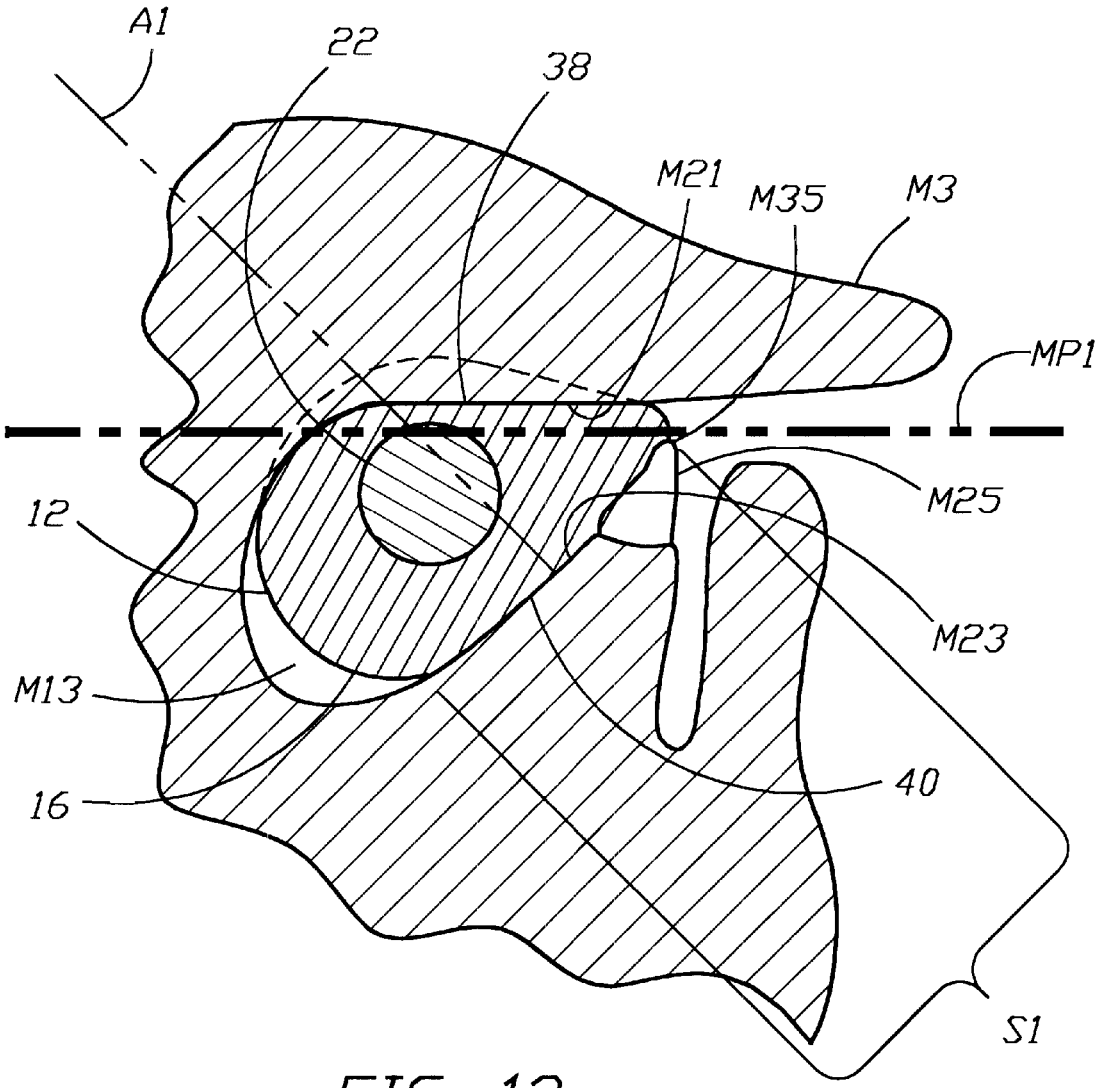
FIG. 12 is a cross-sectioned side view of the mouthpiece of FIGS. 4–8 appropriately positioned in the user's mouth beneath the tongue showing the lower surface contacting the anterior portion of the sub-lingual basin along a span.

The interrelation between features of the mouthpiece 12 and the user's mouth during use is shown in FIG. 12 whereby the lower surface 40 of the constrained portion 16 is held against the anterior portion M23 of the sub-lingual basin M13 as the inferior surface M21 of the tongue M3 presses on the upper surface 38 of the constrained portion 16. When the mouthpiece 12 is so positioned in the sub-lingual basin M13 it is stabilized in three ways. First, since the lower surface 40 has a cylindrically convex contour having a radius R4 (shown in FIG. 8) that compliments the radius R2 of the cylindrically concave contour of the anterior portion M23 of the sub-lingual basin M13 (illustrated in FIG. 3), the mouthpiece 12 is prevented from rotating about any axis A1 that lies along the coincident planes of symmetry MP2, P1, (FIGS. 1, 6 respectively) perpendicular to the anterior portion M23. Second, the cylindrically convex lower surface 40 contacts the cylindrically concave anterior portion M23 along a span S1, which hinders the mouthpiece 12 from rolling upward or downward along the anterior portion M23. And third, the mouthpiece 12 is hindered from slipping as the compliant material of the lower surface 40 embeds somewhat into irregularities and crevices of the anterior portion M23.

During use, it is preferable that a portion of the upper surface 38 adjacent the anterior mandibular teeth M25 be maintained in a position above the occlusal plane MP1. This condition helps to preclude the possibility of the inferior surface M21 of the tongue M3 contacting the upper edges M35 of the anterior mandibular teeth M25, which situation could act to dampen the vibrations that have been transmitted to the tongue M3. To accomplish this condition when using the mouthpiece 12 of the foregoing embodiment, the user learns, with little practice, to simply manipulate the mouthpiece 12 with his/her tongue until he/she feels the vibrations imparted thereto are optimized. For subsequently described embodiments this condition is automatic.

Figure 14:
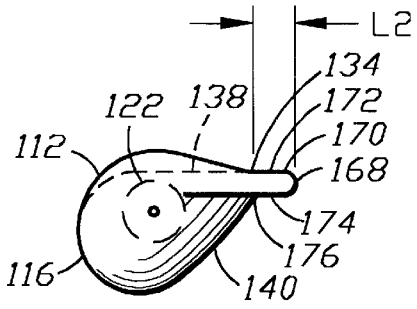
FIG. 14 is a side view of the mouthpiece of FIG. 13.
Figure 13:
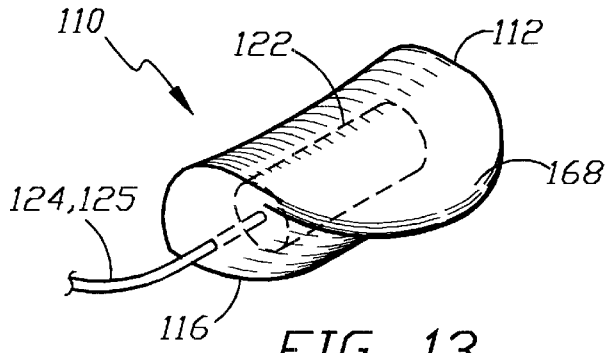
FIG. 13 is an isometric view of an alternative embodiment of a mouthpiece showing additional stabilizing means in the form of a frontal portion comprising a tooth-rest.
Figure 15:
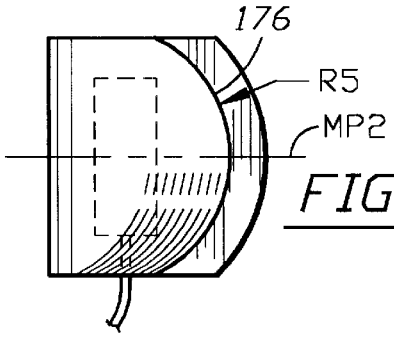
FIG. 15 is an orthographically projected bottom view of the mouthpiece of FIG. 14, showing a curved juncture between the tooth-rest and a lower surface.
Figure 16:
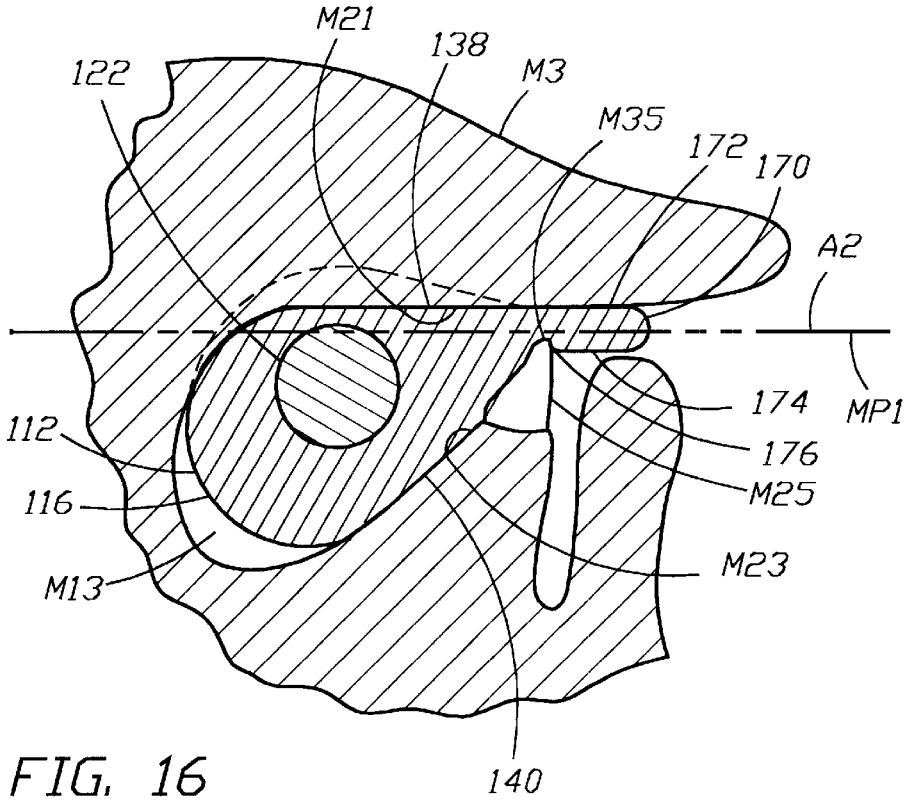
FIG. 16 is a cross-sectioned side view of the mouthpiece of FIGS. 13–15 appropriately positioned in the user's mouth beneath the tongue showing the tooth-rest resting on the user's anterior mandibular teeth.

FIG. 13 shows an alternative embodiment of a device 110 comprising a mouthpiece 112 comprising a constrained portion 116 that is similar to the constrained portion 16 described in reference to FIGS. 4–8. The constrained portion 116 contains an encapsulated vibrator 122 that is interconnected with electric wires 124, 125 to a controller (not shown). As shown in FIG. 14, the mouthpiece 112 additionally comprises a frontal portion 168 that adjoins and protrudes horizontally outward from the anterior end 134 of the constrained portion 116. The frontal portion 168 has a horizontal protrusion length L2 preferably less than 1.0 inch so as not to interfere with the performance of the user's extended tongue. The frontal portion 168 comprises a toothrest 170 having an upper surface 172 that is contiguous with the upper surface 138 of the constrained portion 116, and a bottom surface 174 that intersects the lower surface 140 of the constrained portion 116 at a juncture 176. As shown in FIG. 15, the juncture 176 is curved having a radius R5 that is approximately 0.80 inch that substantially matches the radius R1 of the lingual surfaces M15 of the anterior mandibular teeth M25 shown in FIG. 2. Referring to FIG. 16, as the inferior surface M21 of the tongue M3 rests on the upper surfaces 138, 172 and presses the lower surface 140 into the anterior portion M23 of the sub-lingual basin M13, the bottom surface 174 of the tooth-rest 170 is adapted to rest on, and embed somewhat into, the upper edges M35 of the user's anterior mandibular teeth M25 adjacent the juncture 176. The tooth-rest 170 consequently provides additional stabilizing means as it hinders the mouthpiece 112 from sliding downward along the anterior portion M23 of the sub-lingual basin M13. The tooth-rest 170 also hinders the mouthpiece 112 from rotating about an axis A2 that is coincident with the intersection of the occlusal plane MP1 and the sagittal plane MP2 (FIG. 15). Also, the tooth-rest 170 assures that the tongue M3 only contacts the mouthpiece 112 and not the upper edges M35 of the anterior mandibular teeth M25, which assures that vibrations are optimally imparted to the tongue M3.

Figure 18:
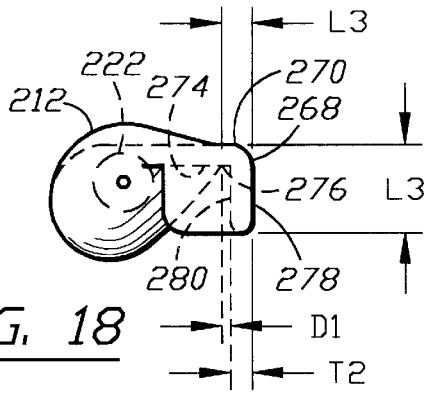
FIG. 18 is a side view of the mouthpiece of FIG. 17.
Figure 17:
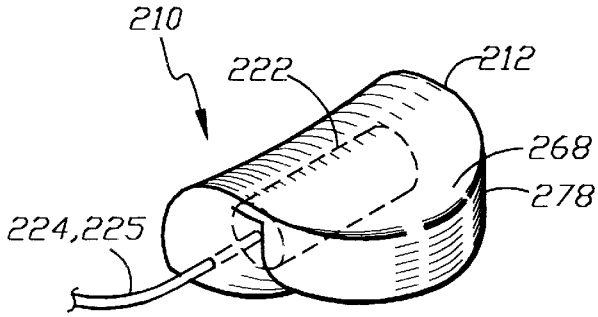
FIG. 17 is an isometric view of another alternative embodiment of a mouthpiece showing another additional stabilizing means in the form of a protuberance that projects downwardly from the anterior edge of the tooth-rest.
Figure 19:
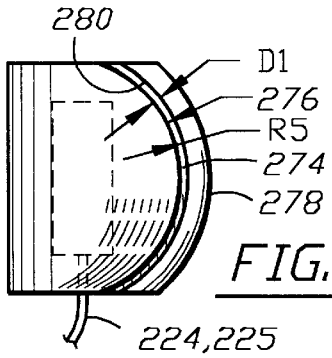
FIG. 19 is an orthographically projected bottom view of the mouthpiece of FIG. 18, showing curvature of the protuberance.
Figure 20:
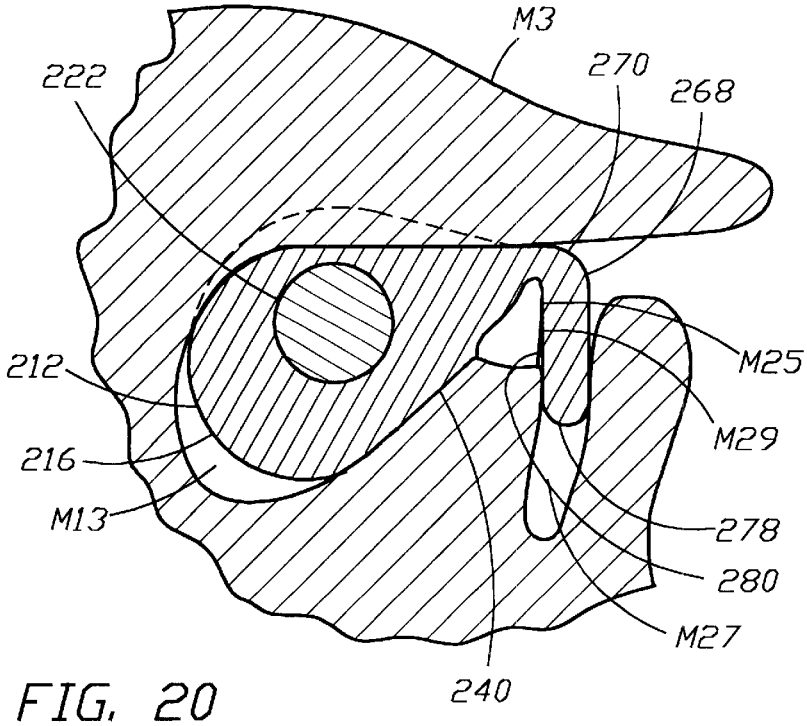
FIG. 20 is a cross-sectioned side view of the mouthpiece of FIGS. 17–19 appropriately positioned in the user's mouth beneath the tongue showing the downward protuberance gripping the user's anterior mandibular teeth and gums in cooperation with the anterior portion of the sub-lingual basin.

FIG. 17 illustrates another alternative embodiment of a device 210 comprising a mouthpiece 212 containing an encapsulated vibrator 222 having wires 224, 225 that interconnect with a controller (not shown). This embodiment is similar to that described with reference to FIGS. 13–16 except a frontal portion 268 is provided that includes additional stabilizing means in the form of a protuberance 278. As shown in FIG. 18, the protuberance 278 projects downwardly from the bottom surface 274 of the tooth-rest 270. The protuberance 278, which has a length L3 and a constant thickness T2, has an inner surface 280 that adjoins the bottom surface 274 of the tooth-rest 270 at a consistent distance D1 from the juncture 276. As shown in FIG. 19, this results in the inner surface 280 having a radius R5 that matches the curvature of the labial surfaces M29 of the anterior mandibular teeth M25 (FIG. 2). As illustrated in FIG. 20, the length L3, thickness T2, and distance D1 (FIG. 18) are such that the protuberance 278 is adapted to comfortably protrude into the vestibule M27 when the constrained portion 216 is appropriately positioned in the sub-lingual basin M13. When so positioned the inner surface 280 of the protuberance 278 grips the labial surface M29 of the anterior mandibular teeth M25 in cooperation with the lower surface 240 of the constrained portion 216. Accordingly, and in conjunction with the tooth-rest 270, the mouthpiece 212 is stabilized and hindered from moving downward, or in either an anterior or posterior direction.

Figure 22:
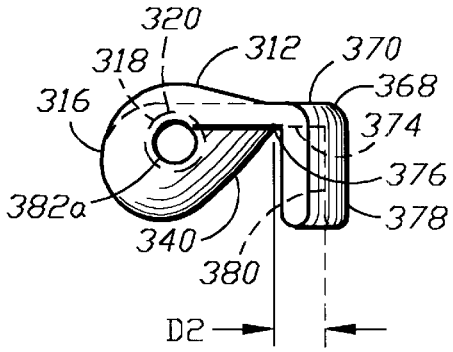
FIG. 22 is a side view of the mouthpiece of FIG. 21 showing an alternative stabilizing means in the form of a downwardly projecting protuberance adapted to contact the outer surface of the user's lower lip.
Figure 21:
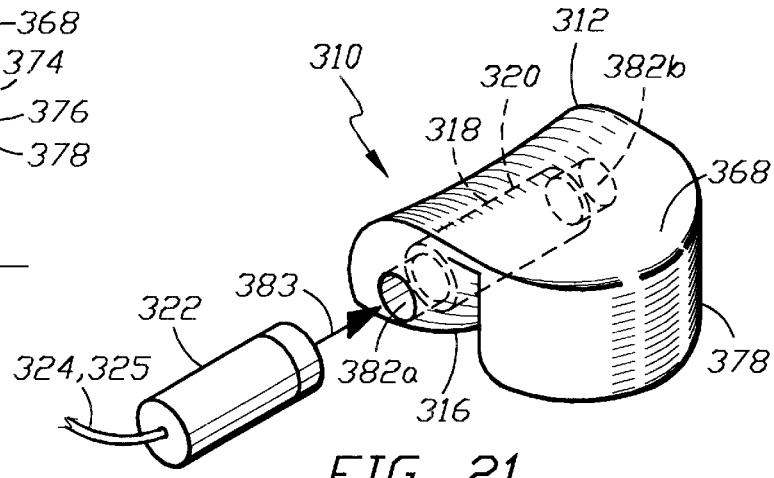
FIG. 21 is an isometric view of even another alternative embodiment of a mouthpiece showing an installable/removable vibrator poised for installation through an opening.
Figure 23:
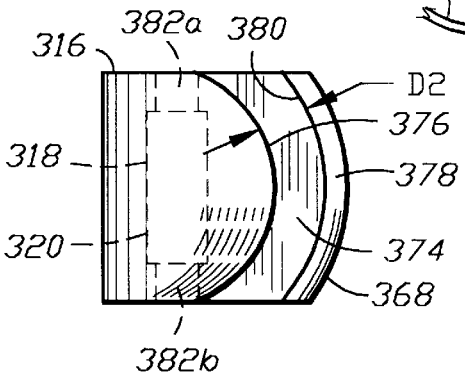
FIG. 23 is an orthographically projected bottom view of the mouthpiece of FIG. 22, showing curvature of the protuberance.
Figure 24:
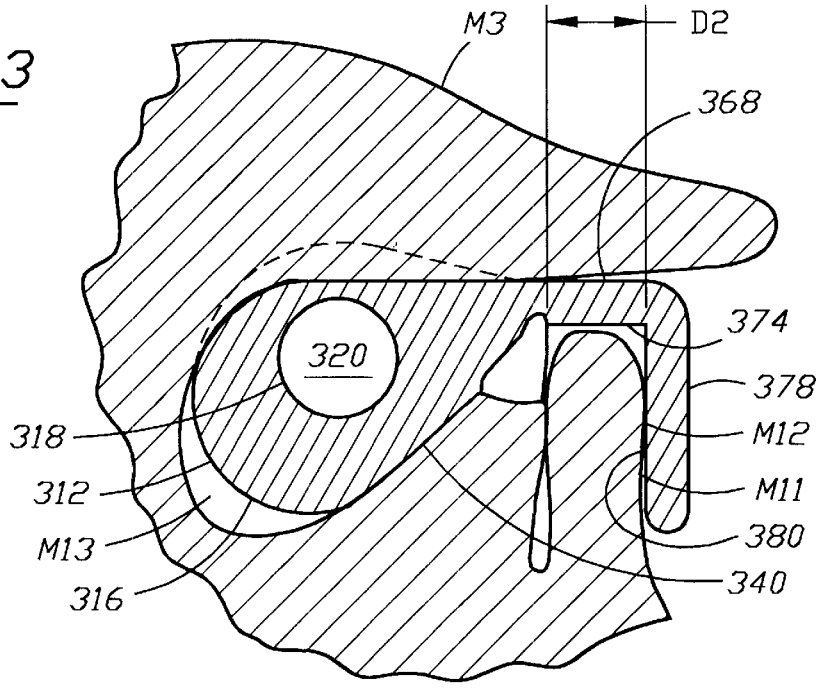
FIG. 24 is a cross-sectioned side view of the mouthpiece of FIGS. 21–23 appropriately positioned in the user's mouth beneath the tongue showing the downward protuberance gripping the outer surface of the user's lower lip in cooperation with the anterior portion of the sub-lingual basin.

FIG. 21 illustrates even another alternative embodiment of a device 310 comprising a mouthpiece 312 that comprises a constrained portion 316, a frontal portion 368 and an installable/removable vibrator 322 that is interconnected by electric wires 324, 325 to a controller (not shown). The constrained portion 316, which is similar with respect to material and external geometry to those previously described, includes a retaining means 318 comprising a chamber 320 that is sized to accommodate the vibrator 322. However, in this embodiment the constrained portion 316 has two opposite lateral openings 382*a*, 382*b*, respectively, that lead to the chamber 320. Each opening 382*a*, 382*b* has a diameter large enough that the elastomeric material of the constrained portion 316 can expand sufficiently to allow installation and removal of the vibrator 322, yet small enough to adequately retain the vibrator 322 after it is installed. Accordingly, the vibrator 322, shown removed, is installable into the retaining means 318 through the opening 382*a* along a path indicated by an arrow 383. Alternatively, the vibrator 322 could just as easily be installed through the opening 382*b*. For purposes of installing, removing, and retaining the vibrator 322, the chamber 320, by necessity, need only have one opening leading thereto. However, it is preferable to have the opposite openings 382*a*, 382*b* described above which allow through flushing of the chamber 320 during cleaning. Since the vibrator 322 in this embodiment is subject to exposure to moisture such as saliva during use and solvents during cleaning, it is hermetically sealed to preclude environments conducive to the propagation of deleterious microorganisms and to protect its electronics from moisture, which could cause electrical shorting. Although the vibrator 322 is shown to be installable/removable in conjunction with this embodiment, it will be apparent to those skilled in the art that other embodiments described herein could just as easily incorporate a retaining means into/from which a vibrator is installable/removable. As shown in FIGS. 22 and 23, the frontal portion 368 is similar to the frontal portion 268 of the mouthpiece 212 (FIGS. 17–20) except the inner surface 380 of the protuberance 378 is spaced from the juncture 376 between the lower surface 340 of the constrained portion 316 and the bottom surface 374 of the tooth-rest 370 at a constant distance D2 that is greater than the distance D1 of mouthpiece 212 (FIGS. 17–20). As shown in FIG. 24, the distance D2 is such that the inner surface 380 of the protuberance 378 is adapted to grip the outer surface M12 of the user's lower lip M11 in cooperation with the lower surface 340 of the constrained portion 316, thereby hindering downward, posterior, and anterior movement of the mouthpiece 312 in similar manner to the mouthpiece 212 (FIGS. 17–20).

Figure 25:
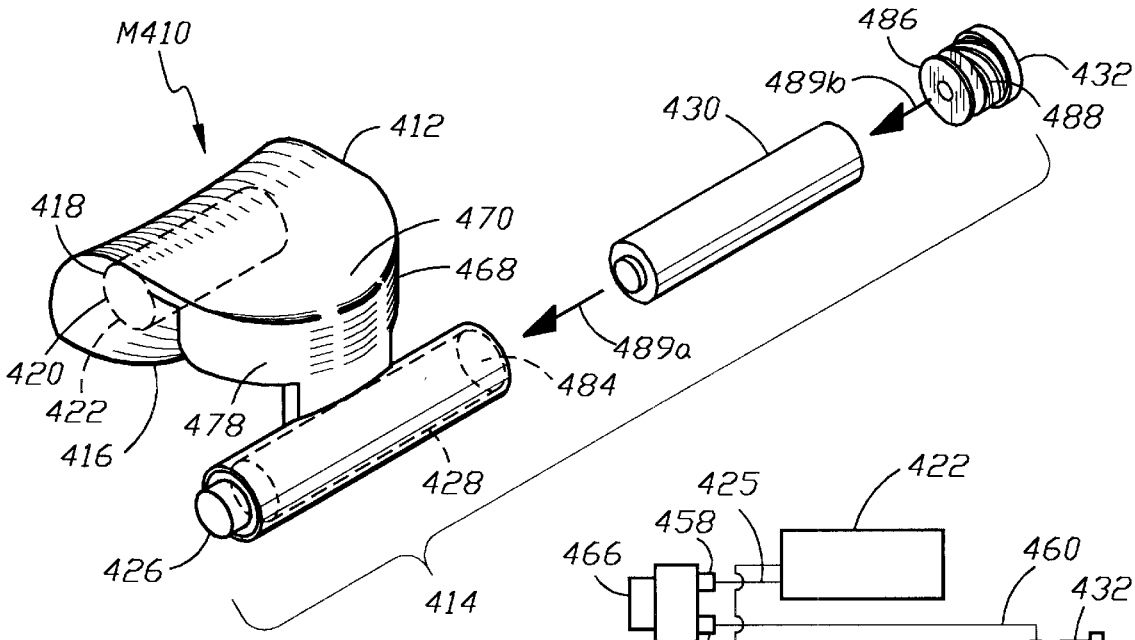
FIG. 25 is an exploded isometric view of even another alternative embodiment of the present invention showing a device comprising a mouthpiece having a frontal portion comprising a controller.
Figure 26:
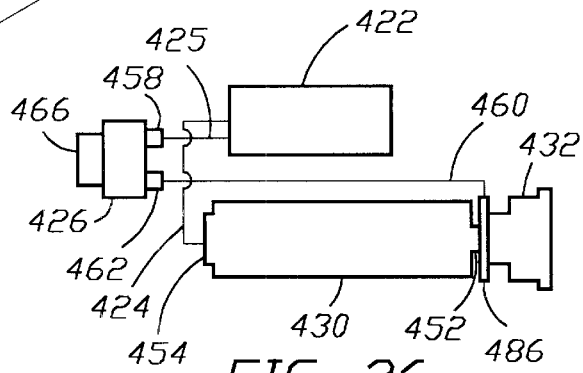
FIG. 26 is a wiring diagram showing electrical interconnections between electrical components of the device of FIG. 25.
Figure 27:
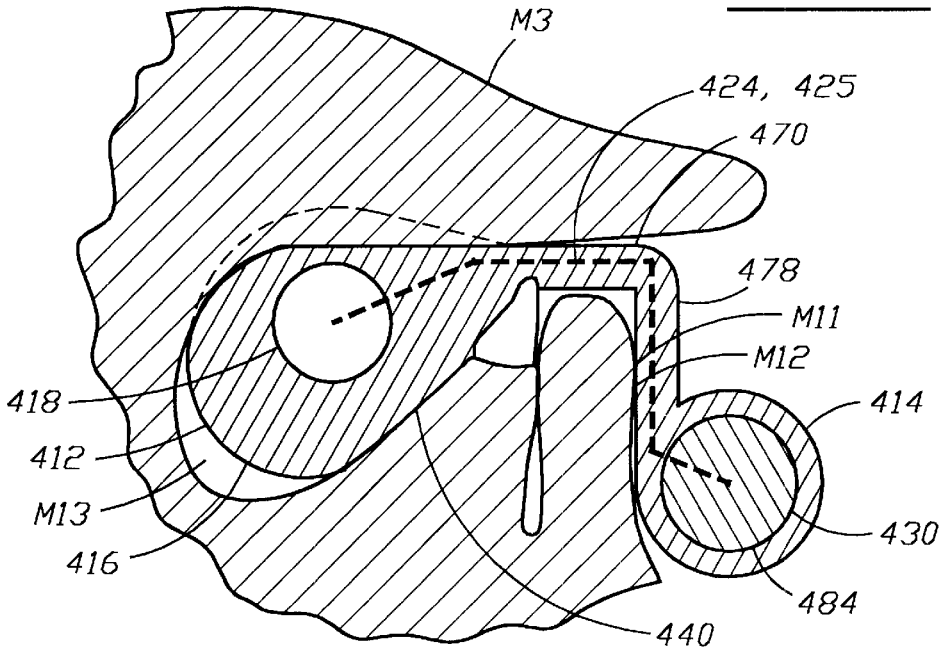
FIG. 27 is a cross-sectioned side view of the device of FIG. 25 in a user's mouth showing a downwardly projecting protuberance comprising a battery compartment.

FIG. 25 shows yet even another embodiment of a device 410 of the present invention comprising a mouthpiece 412 that comprises a constrained portion 416 and a frontal portion 468. The mouthpiece 412 is geometrically similar to the mouthpiece 312 (FIGS. 21–24) except: (a) the constrained portion 416 includes a retaining means 418 comprising a hermetically sealed chamber 420 that permanently encapsulates a vibrator 422; and (b) a controller 414 is provided that is attached to and integral with a protuberance 478 that projects downward from a tooth-rest 470 of the frontal portion 468. The controller 414 comprises a push-button switch 426, a battery compartment 428, a battery 430, and a separable cover 432. The battery compartment 428 has an opening 484 at one end that serves to provide access thereto. The separable cover 432 has an attached electrical conductor 486 that faces the battery 430, and also has a male screw thread 488 that mates with a female screw thread (not shown) in the opening 484 when the battery 430 and cover 432 are installed in/on the battery compartment 428 along a path indicated by arrows 489*a*, 489*b*, respectively. As illustrated in FIG. 26, when the battery 430 and cover 432 are so installed, a first electrical conductor 424 is provided between the vibrator 422 and the negative terminal 454 on the battery 430, a second electrical conductor 425 is provided between a first terminal 458 on the switch 426 and the vibrator 422, and a third electrical conductor interconnects a second terminal 462 on the switch 426 with the conductor 486 on the cover 432 that, in turn, interconnects with the positive terminal 452 on the battery 430. The switch 426 includes an actuator 466 that functions to make or break the electrical connection between the battery 430 and the vibrator 422. Such connections between electrical components are common practice in electromechanical sexual aid devices and are well understood by those skilled in the art. As shown in FIG. 27, the protuberance 478 is adapted to grip the outer surface M12 of user's lower lip M11 in cooperation with the lower surface 440 of the constrained portion 416 thereby providing a stabilizing means. It is also shown that the first and second electrical conductors 424, 425, respectively, are preferably embedded within the protuberance 478, the tooth-rest 470, and the constrained portion 416 so as to protect them from wear and shorting. This is accomplished, for example, by over-molding, a process well known to those knowledgeable in the art.

Figure 28:
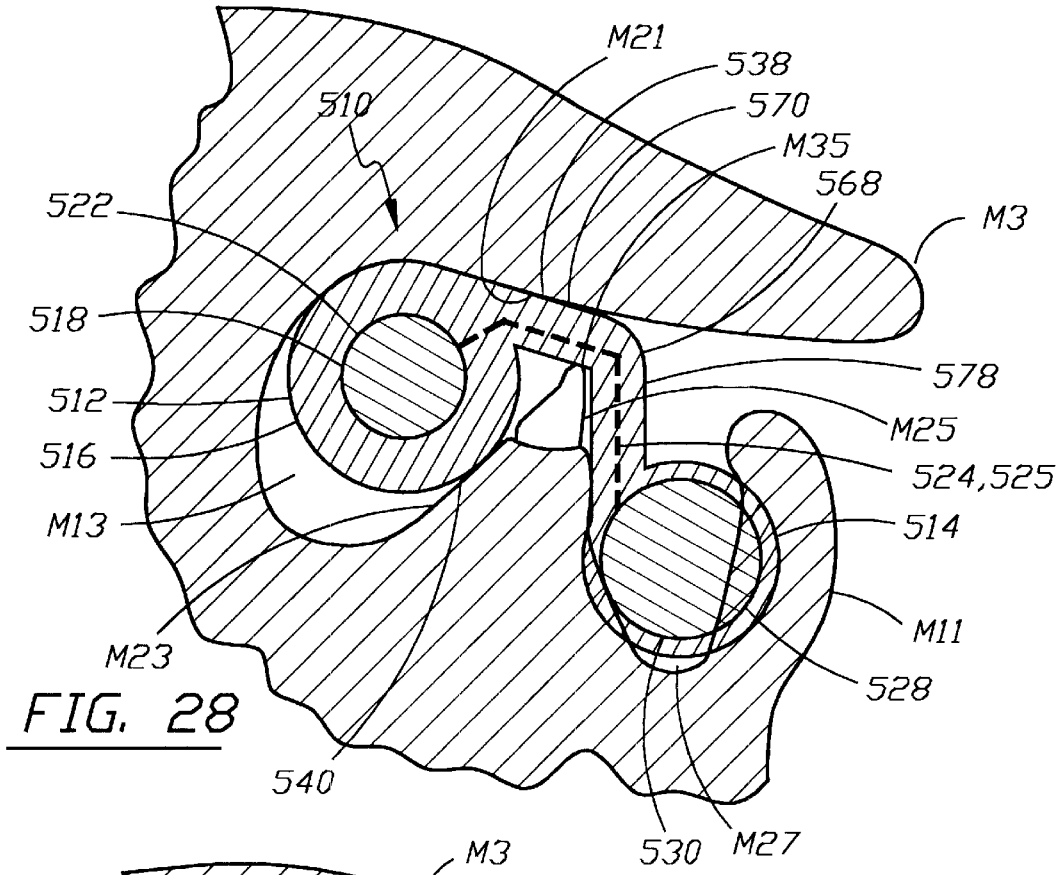
FIG. 28 is a cross-sectioned side view of still another alternative embodiment of a mouthpiece showing a downwardly projecting protuberance comprising a controller situated in the vestibule between the anterior surface of the user's mandibular teeth and gums and the inner surface of the lower lip.

Still another alternative embodiment of a device 510 of the present invention is illustrated in FIG. 28 whereby a mouthpiece 512 is shown comprising a constrained portion 516 and a frontal portion 568. The constrained portion 516 has a retaining means 518 that permanently encapsulates a vibrator 522. The constrained portion 516, which is substantially cylindrical in form and adapted to fit in the sub-lingual basin M13, has an upper surface 538 that contacts the inferior surface M21 of the tongue M3, and a lower surface 540 that contacts the anterior portion M23 of the sub-lingual basin M13. The frontal portion 568 comprises a tooth-rest 570 that rests on the upper edges M35 of the user's anterior mandibular teeth M25, and a downwardly projecting protuberance 578 that includes a controller 514 at its lower end whereby the protuberance 578 and controller 514 are adapted to fit in the vestibule M27. The constrained portion 516, tooth-rest 570, protuberance 578 and controller 514 all cooperate to act as stabilizing means for the mouthpiece 512. The controller 514 comprises a battery compartment 528, a battery 530, a cover (not shown) and a switch (not shown), and is similar to the controller 414 described in conjunction with FIGS. 25–27. Also, like the mouthpiece 414, the mouthpiece 512 includes embedded first and second electrical conductors 524, 525, respectively, that interconnect the vibrator 522 with the controller 514. The tooth-rest 570 and protuberance 578 act as stabilizing means in similar manner to the tooth-rest 270 and protuberance 278 (FIGS. 17–20).

Figure 29:
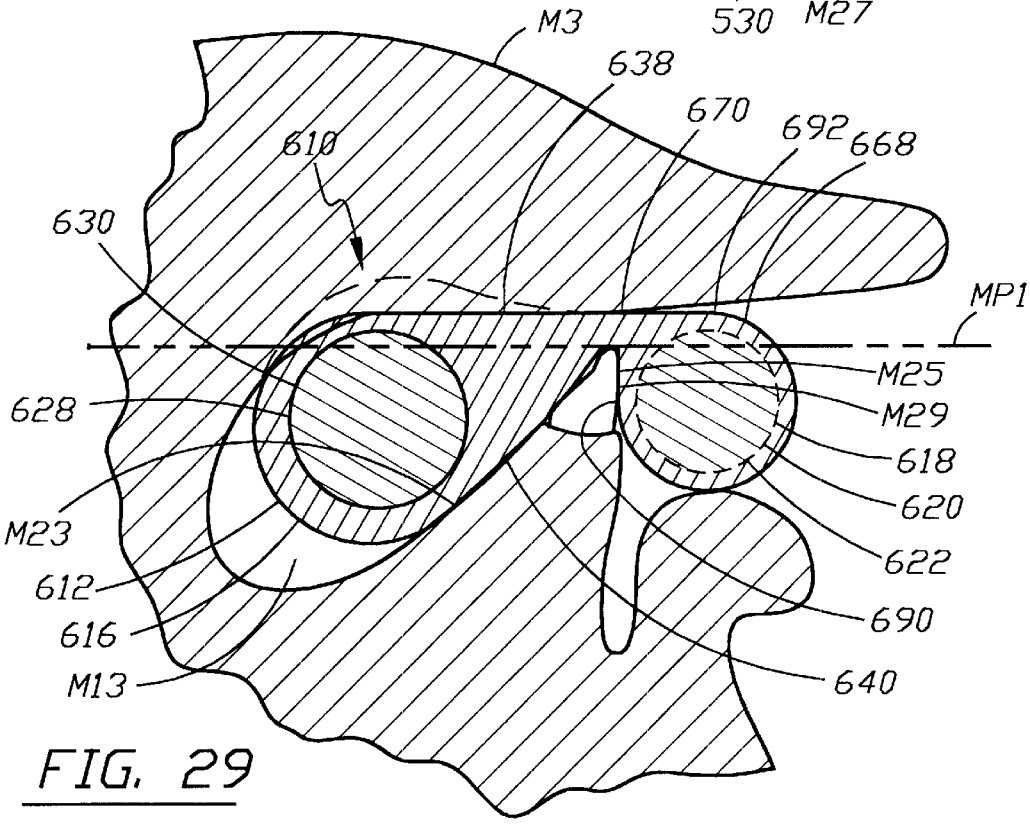
FIG. 29 is a cross-sectioned side view of even still another alternative embodiment of a mouthpiece showing a controller situated in a constrained portion, and a retaining means situated in a frontal portion.

Even still another alternative embodiment a device 610 of the present invention comprising a mouthpiece 612 having a constrained portion 616 and a frontal portion 668 is shown in FIG. 29. In this embodiment the constrained portion 616 has external geometry similar to the constrained portion 16 (FIGS. 5–8) in that it is elongate and has an upper surface 638 on which the user's tongue M3 rests, and a lower surface 640 that contacts the anterior portion M23 of the sublingual basin M13. However, in this embodiment the constrained portion 616 comprises at least a battery compartment 628 that houses a battery. That battery compartment includes an installable/removable cover (not shown) that is similar in form and function to the cover 432 (FIGS. 25, 26). When assembled, the cover forms a hermetic seal with the battery compartment 628 thereby preventing the intrusion of moisture, which is important for reasons previously discussed. The frontal portion 668 comprises a tooth-rest 670 and a retaining means 618 comprising a chamber 620 that retains a vibrator 622 that is permanently encapsulated and hermetically sealed within the chamber 620. The retaining means 618 has a posterior surface 690 that grips the labial surfaces M29 of the anterior mandibular teeth M25 in cooperation with the lower surface 640 of the constrained portion 616 and accordingly acts as stabilizing means in conjunction with the tooth-rest 670. It is preferable that an upper surface 692 of the retaining means 618 adjacent the vibrator 622 be above the occlusal plane MP1 to assure vibrations are optimally imparted to the tongue M3. An electric switch (not shown) may be provided either within the constrained portion 616 or as part of the frontal portion 668. In either case, the switch is hermetically sealed. Alternatively, the switch may be located remote from the mouthpiece 612 altogether in which case it is connected thereto by electrical conductors such as wires (not shown). In any case, the electrical conductors (not shown) interconnect the vibrator 622, battery 630 and switch 626 in similar manner to that illustrated schematically in FIG. 26 with respect to the device 410.

Figure 30:
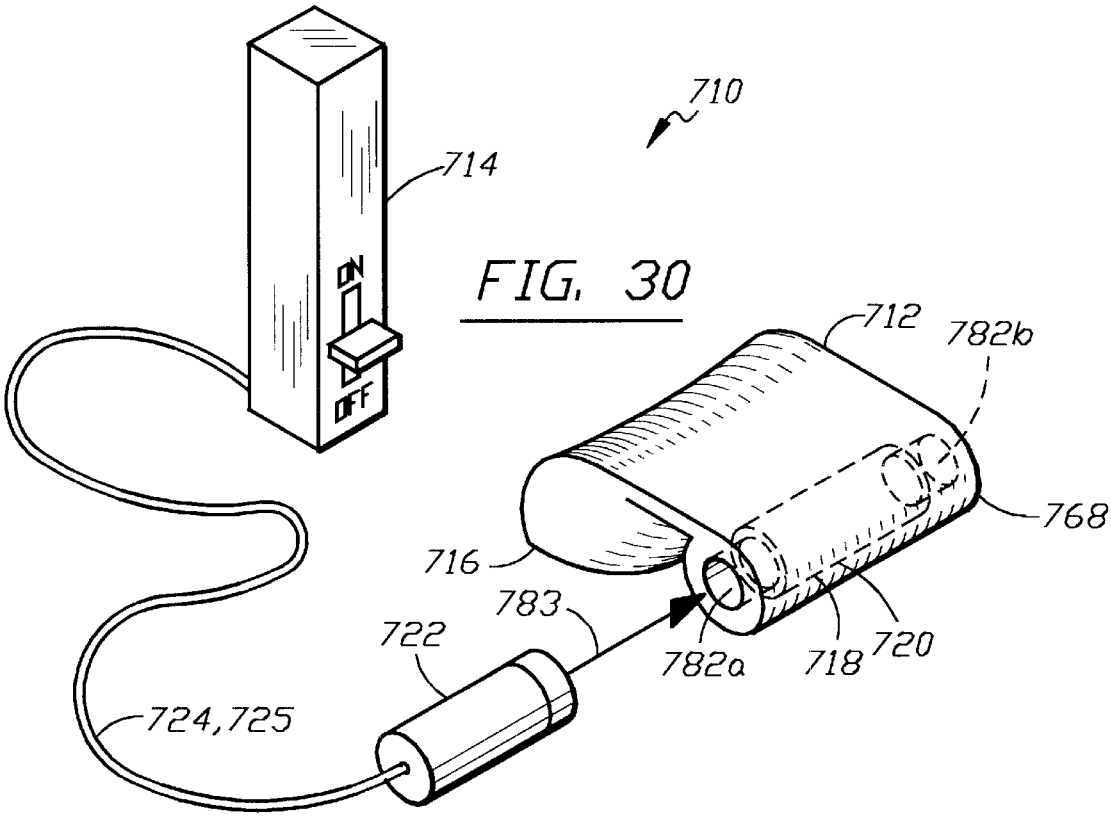
FIG. 30 is an isometric view of a variation of the device of FIG. 29 showing a vibrator that is installable/removable from a frontal portion.

A variation of the device 610 (FIG. 29) is shown in FIG. 30 whereby a device 710 comprises a remote controller 714 having electrical conductors 724, 725 that interconnect with a vibrator 722. A discrete mouthpiece 712 is provided comprising a constrained portion 716 and a frontal portion 768. However, in this embodiment, the constrained portion 716 functions only as a stabilizing means. The frontal portion 768 includes a retaining means 718 comprising a chamber 720 having openings 782*a*, 782*b* leading thereto whereby the vibrator 722 (shown removed) is installable into the chamber 720 through the opening 782*a* along a path indicated by an arrow 783. The vibrator 722 could alternatively be permanently encapsulated in the retaining means 718.

Figure 31:
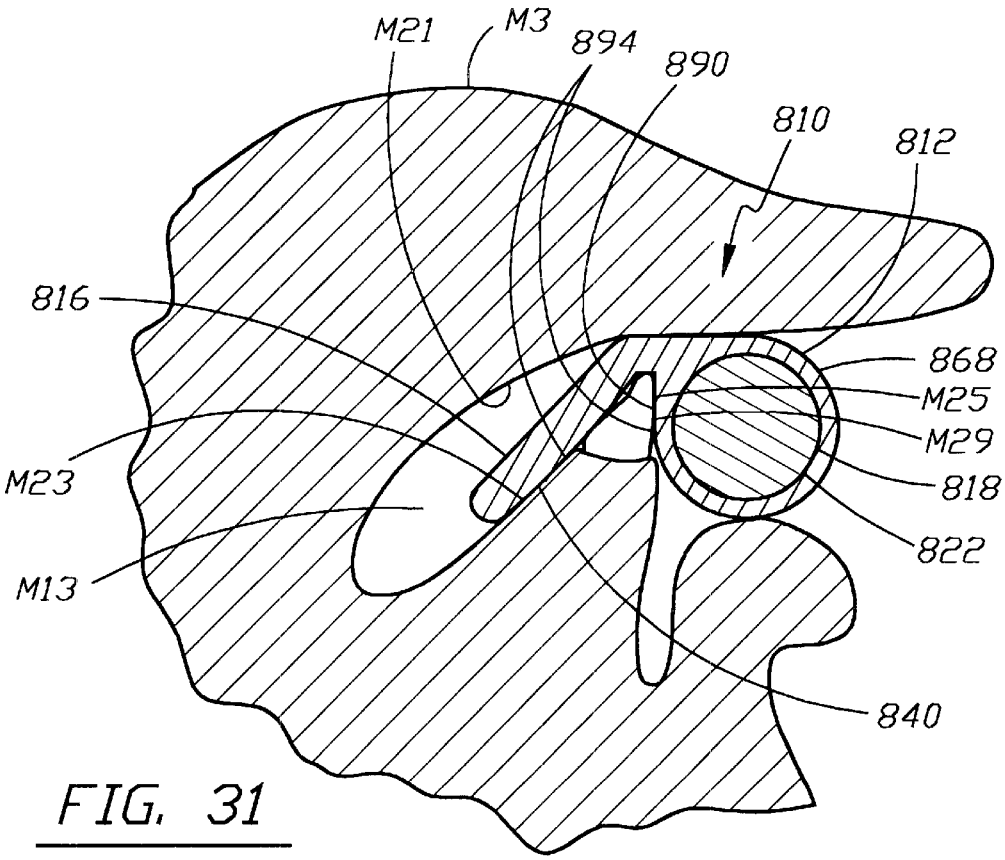
FIG. 31 is a cross-sectioned side view of a mouthpiece utilizing an adhesive as a stabilizing means.

Stabilization of any of the foregoing embodiments can be enhanced by the use of a suitable adhesive, such as denture adhesive, when it is applied to surfaces of the mouthpiece adapted to contact the mandibular teeth and/or gums. Other alternative embodiments, intended explicitly for use with adhesives, may be provided whereby certain stabilizing features may be reduced or eliminated. For example, a mouthpiece 812 of a device 810 is shown in FIG. 31, whereby the mouthpiece 812 comprises a constrained portion 816 and a frontal portion 868 that comprises a retaining means 818 that retains a vibrator 822 that interconnects with a remote controller (not shown). An adhesive 894 is applied between the lower surface 840 of the constrained portion 816 and the anterior portion M23 of the sub-lingual basin M13, and also between labial surfaces M29 of the anterior mandibular teeth M25 and a posterior surface 890 of the retaining means 818. The use of the adhesive negates the need for the inferior surface M21 of the tongue M3 to press the constrained portion 816 into the anterior portion M23 for stabilization purposes. Accordingly the constrained portion 816 may be thinner, as shown, which affords more comfort to the user.

Figure 33:
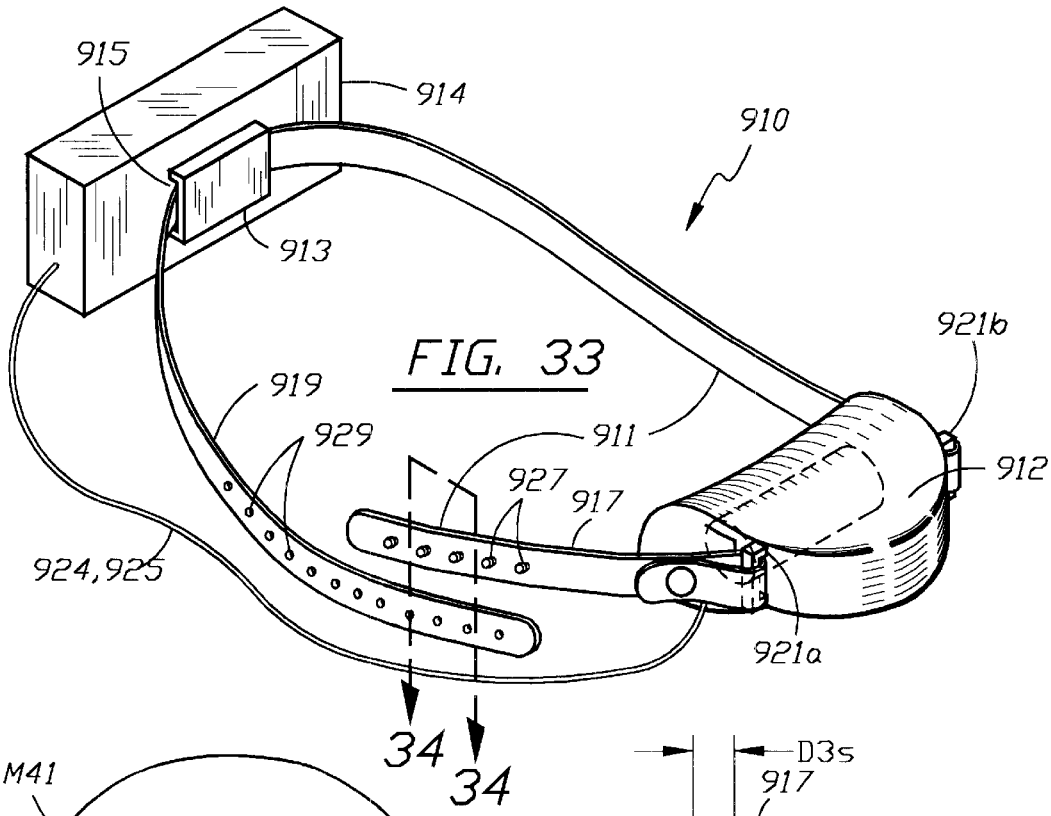
FIG. 33 is an isometric view of the device of FIG. 32 showing an adjustment means for the stabilizing band and an attachment means on a controller.
Figure 32:
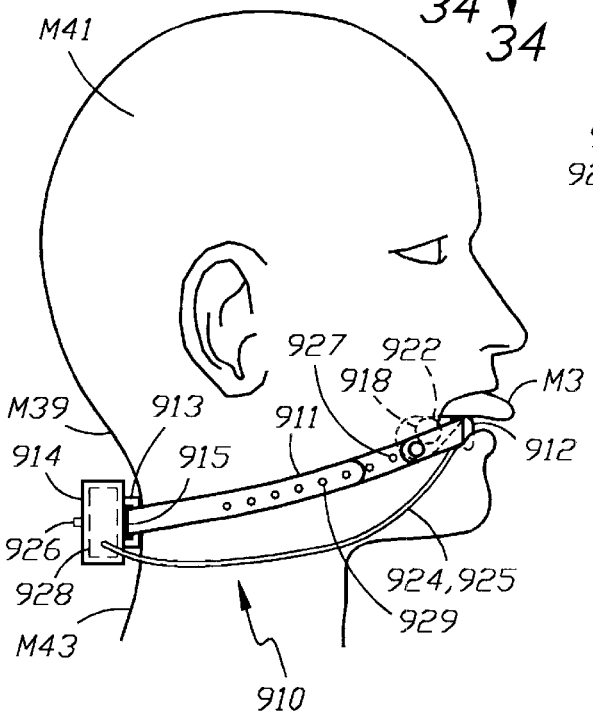
FIG. 32 is a side view of a device showing a mouthpiece having an external stabilizing means comprising a stabilizing band that passes behind a user's neck.
Figure 34:
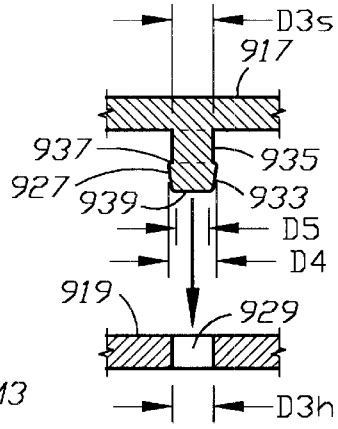
FIG. 34 is a cross-sectioned top view taken along lines 34—34 of FIG. 33 showing means for attaching a first strap to a second strap.
Figure 35:
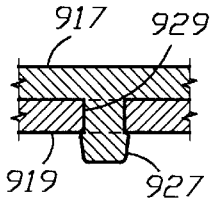
FIG. 35 is a top view of the first and second straps of FIG. 34 showing the straps in an attached condition.

Stabilization can also be accomplished by external means. For example, referring to FIG. 32, a device 910 is shown comprising a remote controller 914 and a mouthpiece 912 that contains a retaining means 918 that retains a vibrator 922. The controller 914, which comprises a battery compartment 928 and an electric switch 926, is interconnected to the vibrator 922 with electrical conductors 924, 925. The device 910 additionally comprises an adjustable stabilizing band 911 that is attached to the mouthpiece 912. The stabilizing band 911, which is preferably made of an elastic material, passes behind the posterior surface M39 of the user's head M41 or neck M43 whereby it imparts a rearward stabilizing force on the mouthpiece 912 such that the vibrator 922 remains properly positioned to optimally impart vibrations to the tongue M3. The stabilizing band 911 also prevents the vibrator 922 from moving to a position where it could irritatingly contact the user's teeth. The controller 914 additionally includes an attachment means 913 that functions to attach it to the stabilizing band 911. In the embodiment shown, the attachment means 913 comprises an opening 915 through which the stabilizing band 911 slidably passes. Thus restrained, the controller 914 and conductors 924, 925 are conveniently situated so as not to encumber the activities of the user. As shown in FIG. 33, a preferred embodiment of the stabilizing band 911 comprises first and second straps 917, 919, respectively, that are attached to first and second connection means 921*a*, 921*b*, respectively, that are laterally disposed on the mouthpiece 912. The first strap 917 comprises a plurality of equally spaced mushroom-shaped bosses 927 and the second strap 919 comprises a plurality of round, similarly spaced, holes 929. As shown in FIGS. 34, 35, the bosses 927 comprise a head portion 933 and a stem portion 935. The stem portion 935 has a diameter D3s that is substantially equal to a diameter D3h of the holes 929 while the head portion 933 has a somewhat larger diameter D4 adjacent its juncture 937 with the stem portion 935 and tapers therefrom to a somewhat smaller diameter D5 at its distal end 939. The diameters D3s, D3h, D4, D5 are such that the bosses 927 can readily be snapped into and out of the holes 929. This geometry enables the user to attach the first strap 917 to the second strap 919 by aligning at least some of the bosses 927 with some of the holes 929 and pressing the straps 917, 919 together. Alternatively, the straps 917, 919 are separable from one another by simply pulling them apart. Also, since the bosses 927 and holes 929 have the same incremental spacing, individual users can suitably adjust the overall length of the stabilizing band 911 by selecting an appropriate array of bosses 927 to snap into an appropriate array of holes 929. And, since at least a portion of the stabilizing band 911 is made of an elastic material proper, its proper fit and function is even further assured.

Figures 36, 37, 38:
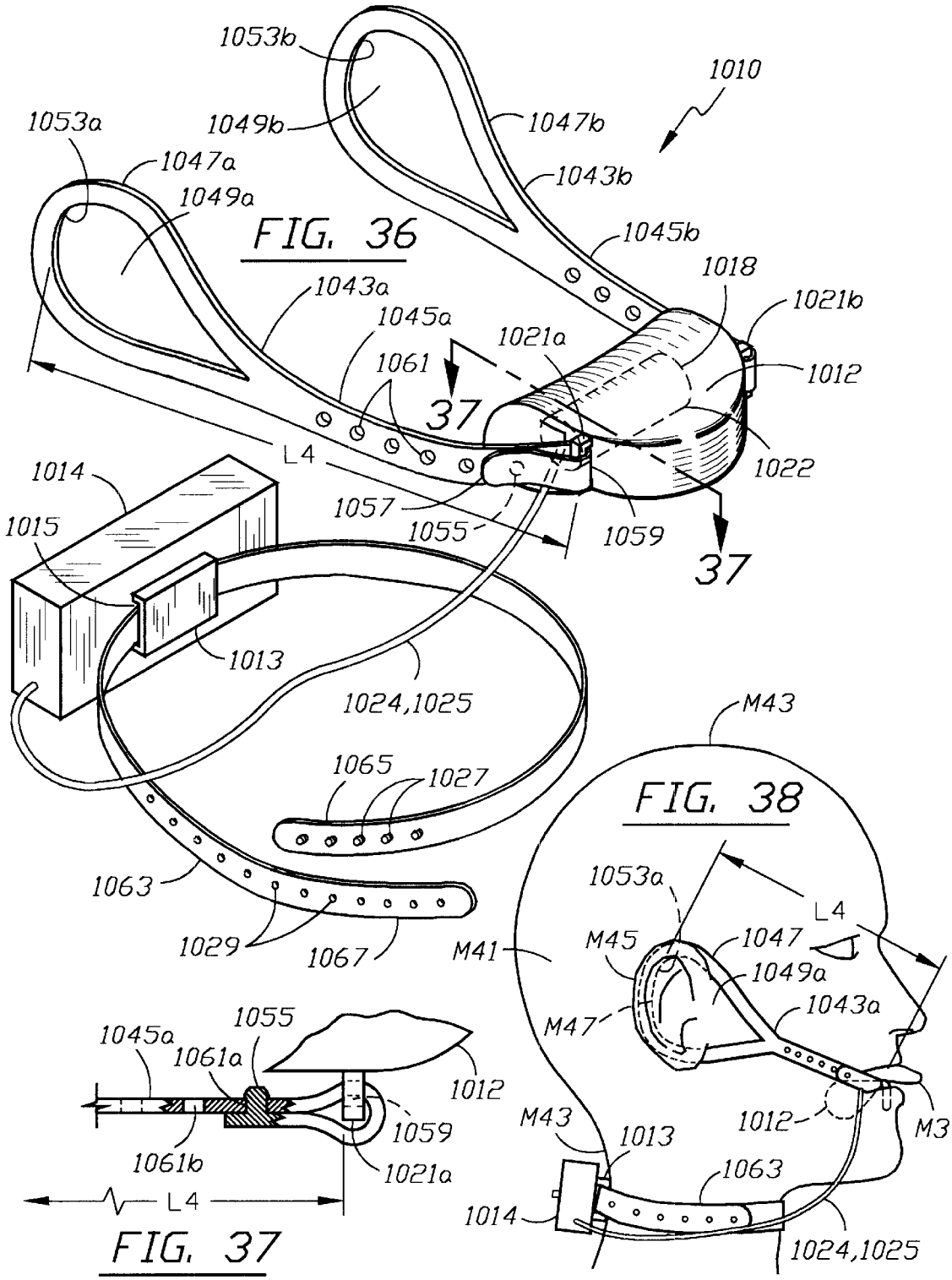
FIG. 36 is an isometric view of a device showing an alternative external stabilizing means comprising ear-straps and also showing a controller attached to a collar.
FIG. 37 is a partially cross-sectioned top view taken along lines 37—37 of FIG. 36 showing a means to adjustably connect the ear-strap to a connection means on a mouthpiece.
FIG. 38 is a side view of the device of FIG. 36 showing the disposition of the ear-straps and the collar on a user.

FIG. 36 shows a device 1010 comprising a controller 1014 and a mouthpiece 1012 comprising a retaining means 1018 that retains a vibrator 1022. The controller 1014 is connected to the vibrator 1022 by electric conductors 1024, 1025. The device 1010 additionally includes an alternative external stabilizing means comprising first and second ear-straps 1043*a*, 1043*b*, respectively, that are attached to first and second connection means 1021*a*, 1021*b*, respectively, that are laterally disposed on the mouthpiece 1012. The ear-straps 1043*a*, 1043*b*, which are preferably made of an elastic material and are mirror images of one another, include strap portions 1045*a*, 1045*b*, respectively, and loop portions 1047*a*, 1047*b*, respectively. The loop portions 1047*a*, 1047*b*, have openings 1049*a*, 1049*b*, respectively, that have rearward surfaces 1053*a*, 1053*b*, respectively. Each ear strap 1043*a*, 1043*b* has a length L4 from rearward surfaces 1053*a*, 1053*b*, respectively, to connection means 1021*a*, 1021*b*, respectively. Preferably, the ear-straps 1043*a*, 1043*b* include an adjustment means whereby the length L4 is adjustable. With reference to ear-strap 1043*a*, the adjustment means comprises a mushroom-shaped boss 1055 located adjacent an anterior end 1057 of the strap portion 1045*a*, and a plurality of holes 1061 located posterior thereto, whereby the boss 1055 is adapted to snap-fit into any of the holes 1061. Adjustment is accomplished by passing the anterior end 1057 through an opening 1059 in the connection means 1021*a* and pressing the boss 1055 into a selected one of the holes 1061. For example, FIG. 37 shows the boss 1055 pressed into the hole 1061*a* thereby providing a certain length L4, whereas pressing the boss 1055 into the hole 1061*b* would provide an adjusted, shorter length L4. As shown in FIG. 38, the loop portion 1047 is placed around the user's right ear M45 and the length L4 is adjusted such that the rearward surface 1053*a* contacts the back surface M47 of the ear M45 adjacent the user's head M41. Ear-strap 1043*b* (not shown) would similarly be placed and adjusted on the user's left ear. So positioned, and with the intrinsic aid of the parent elastic material, the ear-straps 1043*a*, 1043*b* are placed under tension resulting in a rearward stabilizing force on the mouthpiece 1012.

Referring again to FIG. 36, the controller 1014 includes an attachment means 1013 in the form of an opening 1015 that functions to attach it to a collar 1063. The collar 1063 includes an adjustment means comprising a series of equally spaced bosses 1027 at one end 1065 and a series of similarly spaced holes 1029 at the other end 1067 whereby the bosses 1027 and holes 1029 may be interconnected in the manner described above in conjunction with the bosses 927 and holes 929 of the stabilizing band 911 of the device 910. Accordingly, said one end 1065 can be adjustably connected to said other end 1067 such that the collar 1063 can be comfortably fitted on various sized necks of individual users. As shown in FIG. 38, the collar 1063 serves to restrain the controller 1014 at a consistent and convenient location on the user's neck M43, and, consequently, prevent the controller 1014 from inconveniently tugging on the mouthpiece 1012 via the electric conductors 1024, 1025 during use.

Although the present invention has been herein described and illustrated in terms of particular embodiments, it is not limited to these embodiments. Other embodiments, equivalents, and modifications, which would still be encompassed by the invention, can be made by those skilled in the art, particularly in light of the foregoing teachings. Other alternative embodiments, equivalents or modifications, may be included within the spirit and scope of the invention as defined by the claims.

What is claimed is:

1. A device that causes a user's extended tongue to vibrate for purposes of sexual stimulation comprising:

a mouthpiece comprised of a resilient material and having a retaining means that retains a vibrator, at least a portion of said mouth piece adapted to fit in the user's mouth, a surface of said mouthpiece adjacent said vibrator being adapted to contact a surface of the extended tongue such that vibrations may be imparted thereto;

an external stabilizing means attached to said mouthpiece, said external stabilizing means adapted to engage a posterior surface of the user's head, neck, or ears in such manner that a rearward restraining force is imparted to said mouthpiece whereby said mouthpiece is substantially immobilized without causing substantial encumbrance to the mobility and extension of the tongue and otherwise leaving the tongue free to move with respect to said mouthpiece for said purpose, and a controller comprising a battery compartment and an electrical switch, said controller being connected to said vibrator by electrical conductors and functioning to turn said vibrator on and off.

2. The device of claim 1, wherein at least a portion of said external stabilizing means is elastic.

3. The device of claim 2, wherein said external stabilizing means comprises ear-straps.

4. The device of claim 1, wherein said external stabilizing means includes an adjustment means.

5. The device of claim 4, wherein at least a portion of said external stabilizing means is elastic.

6. The device of claim 1, wherein said controller comprises an attachment means.

* * * * *